US010418788B2

(12) United States Patent
Tokumaru

(10) Patent No.: US 10,418,788 B2
(45) Date of Patent: Sep. 17, 2019

(54) SPARK PLUG

(71) Applicant: NGK SPARK PLUG CO., LTD., Nagoya-shi, Aichi (JP)

(72) Inventor: Masaki Tokumaru, Anjo (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/223,225

(22) Filed: Dec. 18, 2018

(65) Prior Publication Data

US 2019/0214793 A1 Jul. 11, 2019

(30) Foreign Application Priority Data

Jan. 10, 2018 (JP) ..... 2018-001558
Aug. 17, 2018 (JP) ..... 2018-153403

(51) Int. Cl.
*H01T 13/32* (2006.01)
*H01T 13/39* (2006.01)

(52) U.S. Cl.
CPC ..... *H01T 13/32* (2013.01); *H01T 13/39* (2013.01)

(58) Field of Classification Search
CPC ..... H01T 13/32
See application file for complete search history.

(56) References Cited

U.S. PATENT DOCUMENTS

2017/0288373 A1* 10/2017 Araya ..... H01T 13/32
2018/0062356 A1* 3/2018 Hanashi ..... H01T 13/32

FOREIGN PATENT DOCUMENTS

JP 2004-152682 A 5/2004

* cited by examiner

*Primary Examiner* — Donald L Raleigh
(74) *Attorney, Agent, or Firm* — Kusner & Jaffe

(57) ABSTRACT

Disclosed is spark plug including: an insulator with an axial hole; a center electrode disposed in a front end side of the axial hole; a cylindrical metal shell holding therein the insulator; and a ground electrode having a rod-shaped electrode base made of a Ni-based material and connected at a base end portion thereof to the metal shell and a tip made of a noble metal-based material and joined to a distal end portion of the electrode base. The distal end portion of the electrode base has a first surface facing a front end surface of the center electrode and second and third surfaces connected to the first surface. The tip includes a first tip member joined to the first surface and a second tip member joined to at least one of the second and third surfaces. The first and second tip members are separated apart from each other.

11 Claims, 8 Drawing Sheets

SPARK PLUG

FIELD OF THE INVENTION

The present invention relates to a spark plug, particularly of the type having a ground electrode with a noble metal-containing tip joined to an electrode base thereof.

BACKGROUND OF THE INVENTION

A spark plug is known, which includes: a metal shell fixed to an engine; a ground electrode having an electrode base coupled to the metal shell and a tip joined to the electrode base and containing a noble metal as a main component; and a center electrode insulatedly held in the metal shell. This spark plug generates, upon breaking of insulation between the center electrode and the ground electrode, spark discharge on a discharge path between the center electrode and the ground electrode. By the flow of air-fuel mixture in a combustion chamber of the engine, the discharge path is extended toward a downstream side of the air-fuel mixture flow. Thus, a spark wear region of the ground electrode increases in area with extension of the discharge path. Japanese Laid-Open Patent Publication No. 2004-152682 discloses a technique to cover the entire electrode base of the ground electrode, except a portion thereof to which the tip is joined, with a protection film of noble metal-based material for the purpose of improvement in spark wear resistance.

SUMMARY OF THE INVENTION

Against the above-disclosed technique, there has been a demand to make a further improvement in the spark wear resistance of the ground electrode.

The present invention has been made in view of such a demand. An advantage of the present invention is a spark plug having a ground electrode with further improved spark wear resistance.

In accordance with a first aspect of the present invention, there is provided a spark plug, comprising: an insulator having an axial hole formed therein in a direction of an axis of the spark plug; a center electrode disposed in a front end side of the axial hole; a cylindrical metal shell holding therein the insulator; and a ground electrode having a rod-shaped ground electrode base made of a Ni-based material and coupled at a base end portion thereof to the metal shell and a ground electrode tip made of a noble metal-based material and joined to a distal end portion of the ground electrode base, wherein the distal end portion of the ground electrode base has: a first surface facing a front end surface of the center electrode; and second and third surfaces connected to the first surface and extending from the distal end portion toward the base end portion of the ground electrode base, wherein the ground electrode tip includes: a first tip member joined to the first surface and having a first discharge surface so as to allow spark discharge between the center electrode and the first discharge surface; and a second tip member joined to at least one of the second and third surfaces and having a second discharge surface so as to allow spark discharge between the center electrode and the second discharge surface, and wherein the first and second tip members are separated apart from each other.

As mentioned above, the rod-shaped ground electrode base of Ni-based material has one (distal) end portion to which the ground electrode tip of noble metal-based material and the other (base) end portion coupled to the metal shell. The ground electrode tip includes two tip members: the first tip member joined to the first surface of the ground electrode base so as to allow spark discharge between the center electrode and the first discharge surface of the first tip member; and the second tip member joined to the at least one of the second and third surfaces of the ground electrode base so as to allow spark discharge between the center electrode and the second discharge surface of the second tip member. Accordingly, spark wear of the at least one of the second and third surfaces of the ground electrode base is suppressed as compared to the case where no second tip member is provided.

Further, the first tip member and the second tip member are separated apart from each other so that, even though the first and second tip members are heated by the spark discharge, the heat can be prevented from directly transferring from the first tip member to the second tip member or from the second tip member to the first tip member through contact of these first and second tip members. The higher the temperature of the tip member, the more susceptible the tip member is to spark wear. A temperature rise of the tip member is prevented by preventing direct heat transfer between the first and second tip members and thereby enhancing heat transfer from the first and second tip members to the ground electrode base. Correspondingly, spark wear of the first and second tip members is suppressed.

It is therefore possible to improve the spark wear resistance of the ground electrode.

In accordance with a second aspect of the present invention, there is provided a spark plug as described above, wherein the first tip member covers at least a part of a side of the first surface to which the at least one of the second and third surfaces is connected.

In this case, the first tip member is arranged to suppress the occurrence of spark wear over a wide area in the vicinity of the side of the first surface. It is thus possible to effectively improve the spark wear resistance of the first surface of the ground electrode base.

In accordance with a third aspect of the present invention, there is provided a spark plug as described above, wherein the second tip member covers at least a part of a side of the at least one of the second and third surfaces to which the first surface is connected.

In this case, the second tip member is arranged to suppress the occurrence of spark wear over a wide area in the vicinity of the side of the at least one of the second and third surfaces. It is thus possible to effectively improve the spark wear resistance of the at least one of the second and third surfaces of the ground electrode base.

In accordance with a fourth aspect of the present invention, there is provided a spark plug as described above, wherein a height of the first tip member from the first surface in a direction perpendicular to the first surface and a height of the second tip member from the at least one of the second and third surfaces in a direction perpendicular to the at least one of the second and third surfaces are 0.1 to 1 mm.

In this case, the first and second tip members, each of which is subjected to spark wear, are provided with sufficient thicknesses. It is thus possible to ensure the lifetime of the ground electrode.

In accordance with a fifth aspect of the present invention, there is provided a spark plug as described above, wherein a first imaginary plane including the first discharge surface and a second imaginary plane including the second discharge surface form an obtuse angle.

In this case, it is more likely that the discharge path between the center electrode and the second discharge surface will be extended toward the center of the combustion chamber by the flow of air-fuel mixture in the combustion chamber as compared to the case where the first and second imaginary planes intersect at a right angle. It is thus possible to effectively improve the ignition performance of the spark plug.

In accordance with a sixth aspect of the present invention, there is provided a spark plug as described above, wherein the obtuse angle is 120 to 170°.

In this case, the discharge path is more readily extended toward the center of the combustion chamber. In is thus possible to more effectively improve the ignition performance of the spark plug.

In accordance with a seventh aspect of the present invention, there is provided a spark plug as described above, wherein a volume of the second tip member is larger than a volume of the first tip member.

In this case, it is possible to ensure the lifetime of the second tip member against spark wear due to the discharge path extended by the air-fuel mixture flow.

In accordance with an eighth aspect of the present invention, there is provided a spark plug as described above, wherein the volume of the second tip member is 1.3 times or more larger than the volume of the first tip member.

In this case, it is possible to more reliably ensure the spark war resistance of the second tip member.

In accordance with a ninth aspect of the present invention, there is provided a spark plug as described above, wherein the center electrode has: a center electrode base; and a center electrode tip made of a noble metal-based material and joined to a front end of the center electrode base through a weld zone, and wherein the weld zone is located inside the axial hole of the insulator.

In this case, the weld zone, which is more susceptible to spark wear than the center electrode tip, is located inside the axial hole of the insulator. It is thus possible to effectively suppress spark wear of the weld zone.

In accordance with a tenth aspect of the present invention, there is provided a spark plug as described above, wherein, when the ground electrode is viewed from a direction perpendicular to the second discharge surface, the entire front end surface of the center electrode is situated within a range of existence of the second tip member in a direction perpendicular to a minimum line segment that connects the front end surface of the center electrode to the first discharge surface of the first tip member.

In this case, spark discharge is more likely to be generated between the center electrode and the second tip member. It is thus possible to effectively suppress spark wear of the at least one of the second and third surfaces of the ground electrode base to which the second electrode tip is joined.

In accordance with an eleventh aspect of the present invention, there is provided a spark plug as described above, wherein, when the ground electrode is viewed from a direction perpendicular to the second discharge surface, the entire first discharge surface of the first tip member is situated within a range of existence of the second tip member in a direction perpendicular to a minimum line segment that connects the front end surface of the center electrode to the first discharge surface of the first tip member.

In this case, a ground electrode-side end of the discharge path is readily shifted from the first tip member to the second tip member by blow-off of the spark discharge. It is thus possible to effectively suppress spark wear of the ground electrode base.

The other advantages and features of the present invention will also become understood from the following description.

DESCRIPTION OF EMBODIMENTS

Hereinafter, exemplary embodiments of the present invention will be described below with reference to the drawings.

First Embodiment

Figure 1:
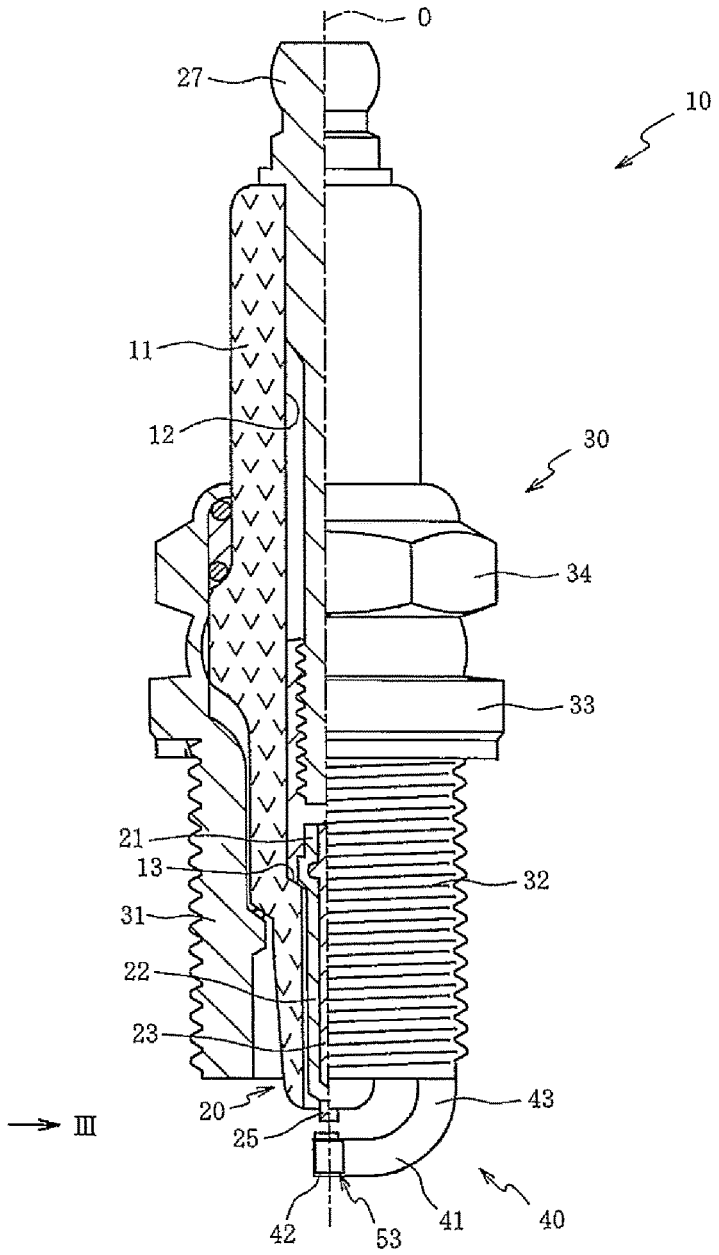
FIG. 1 is a side view, half in section, of a spark plug according to a first embodiment of the present invention.

FIG. 1 is a side view, half in section, of a spark plug 10 for an engine according to the first embodiment of the present invention. In FIG. 1, one side of the spark plug 10 (except a ground electrode 40) with respect to an axis O of the spark plug 10 is shown in cross section. Further, the lower and upper sides of FIG. 1 are respectively referred to as front and rear sides of the spark plug 10. (The same applies to FIGS. 2 to 7.)

As shown in FIG. 1, the spark plug 10 includes an insulator 11, a center electrode 20, a metal shell 30 and a ground electrode 40.

The insulator 11 is substantially cylindrical-shaped, with an axial hole 12 formed therethrough along the axis O, and is made of a ceramic material (such as alumina) with good mechanical properties and high-temperature insulating properties. The insulator 11 has an annular rear-facing surface 13 formed on a front end part of an inner circumferential surface of the axial hole 12 and decreasing in diameter toward the front.

The center electrode 20 is rod-shaped and arranged in the axial hole 12, with a head portion 21 of the center electrode 20 being retained on the rear-facing surface 13 of the insulator 11 and a part of the center electrode 20 other than the head portion 21 being disposed in a front end side of the axial hole 12 which is frontward of the rear-facing surface 13.

In the first embodiment, the center electrode 20 includes: a bottomed cylindrical-shaped electrode base 22 (as a center electrode base); a core 23 embedded in the electrode base 22 and; and a cylindrical column-shaped tip 25 (as a center electrode tip) joined to a front end of the electrode base 22. The electrode base 22 is made of a Ni-based material. The core 33 is made of a Cu-based material. The tip 25 is made of a noble metal-based material. The term "X-based material" as used herein means a material containing X as a main component in an amount of 50 wt % or more. Namely, the electrode base 22 has a chemical composition containing 50 wt % or more of Ni. The core 33 has a chemical composition containing 50 wt % or more of Cu. The tip 25 has a chemical composition containing one kind or two or more kinds of noble metals such as Rt, Rh, Ir and Ru in an amount of 50 wt % or more. The core 23 may optionally be omitted.

The center electrode 20 (more specifically, the head portion 21) is electrically connected to a metal terminal 27 via a conductive part within the axial hole 12.

The metal terminal 27 is made of a conductive metal material (such as low carbon steel) in a rod shape for connection to a high voltage cable (not shown). The metal terminal 27 is fixed in a rear end of the insulator 11, with a front end part of the metal terminal 27 being inserted in a rear end side of the axial hole 12.

The metal shell 30 is substantially cylindrical-shaped and made of a conductive metal material (such as low carbon steel). The metal shell 30 has a body portion 31 located on a front end side thereof. A male thread 32 is formed on an outer circumferential surface of the body portion 31 so as to be screwed into a screw hole of the engine. The metal shell 30 also has a seat portion 33 located rearward of the body portion 31 and a tool engagement portion 34 located rearward of the seat portion 33. The seat portion 33 is made larger in outer diameter than the body portion 31 and adapted to seal a clearance between the screw hole of the engine and the male thread 32 of the body portion 31. The tool engagement portion 31 is engageable with a tool such as wrench for screwing the male thread 31 into the screw hole of the engine.

The ground electrode 40 includes a rod-shaped electrode base 41 (as a ground electrode base) made of a Ni-based material and a cylindrical column-shaped tip 53 (as a ground electrode tip) made of a noble metal-based material and joined to the electrode base 41. The electrode base 41 has two opposite end portions: a distal end portion 42 to which the tip 53 is joined and a base end portion 43 coupled to a front end portion of the metal shell 30. As in the case of the electrode base 22, the electrode base 41 has a chemical composition containing 50 wt % or more of Ni. Although not specifically shown, a core of Cu-based material may be embedded in the electrode base 41. As in the case of the tip 25, the tip 53 has a chemical composition containing one kind or two or more kinds of noble metals such as Rt, Rh, Ir and Ru in an amount of 50 wt % or more.

The ground electrode 40 and the center electrode 20 face each other via a so-called spark gap.

Figure 2:
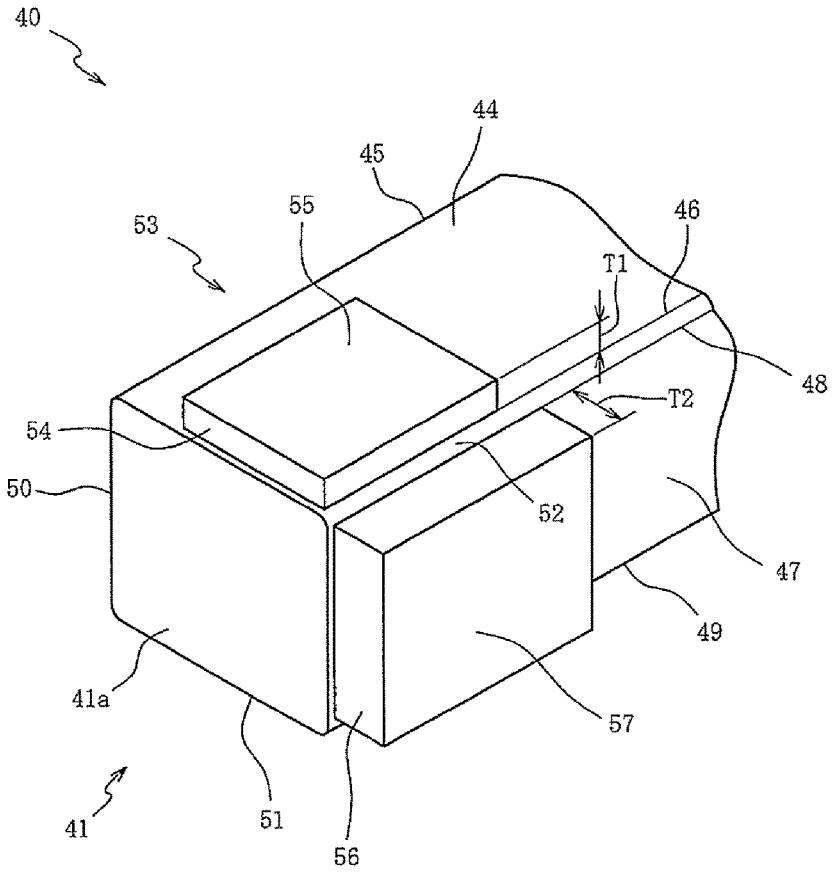
FIG. 2 is a perspective view of a ground electrode of the spark plug.

FIG. 2 is a perspective view of the distal end portion 42 of the ground electrode 40 to which the tip 53 is joined. As shown in FIG. 2, the distal end portion 42 of the electrode base 41 is rectangular in cross section, having: a first surface 44 defined between first and second sides 45 and 46 and facing a front end surface 26 of the center electrode 20 (see FIG. 1); a second surface 47 connected to the second side 46 of the first surface 41 and defined between first and second sides 48 and 49; a third surface 50 connected to the first side 45 of the first surface 44; and a fourth surface 51 connecting the second surface 47 and the third surface 50 to each other. The first to fourth surfaces 44, 47, 50 and 51 are each connected to a distal end surface 41*a* of the electrode base 41 and extend from the distal end portion 42 toward the base end portion 43 (see FIG. 1).

In the first embodiment, the tip 53 includes a first tip member 54 joined at a bottom surface thereof to the first surface 44 and a second tip member 56 joined at a bottom surface thereof to the second surface 47. Each of the first and second tip members 54 and 56 is rectangular parallelepiped (plate)-shaped. The first tip member 54 has a first discharge surface 55 located opposite from the bottom surface thereof and oriented in the same direction as the first surface 44 (i.e. in a direction perpendicular to the axis O), whereas the second tip member 56 has a second discharge surface 57 located opposite from the bottom surface thereof and oriented in the same direction as the second surface 47 (i.e. in a direction parallel to the axis O).

A height T1 of the first tip member 54 from the first surface 44 in a direction perpendicular to the first surface 44 is 0.1 mm to 1 mm. A height T2 of the second tip member 56 from the second surface 47 in a direction perpendicular to the second surface 47 is also 0.1 mm to 1 mm. In this configuration, the first and second tip members 56 provided with sufficient thicknesses so that the ground electrode 40 can ensure lifetime against spark wear.

As shown in FIG. 2, the second surface 47 is connected to the first surface 44 via a chamfered region 52. The chamfered region 52 shares the second side 46 with the first surface 44 and shares the first side 48 with the second surface 47. In the first embodiment, the chamfered region 52 is formed as a round curved surface. The first tip member 54 is arranged to cover a part of the second side 46 of the first surface 44 (in the first embodiment, a part of the second side 46 in the vicinity of the distal end surface 41*a*). The second tip member 56 is arranged to cover a part of the first side 48 of the second surface 47 (in the first embodiment, a part of the first side 47 in the vicinity of the distal end surface 41*a*). The first and second tip members 54 and 56 are consequently separated apart from each other by a distance of the chamfered region 52.

Figure 3:
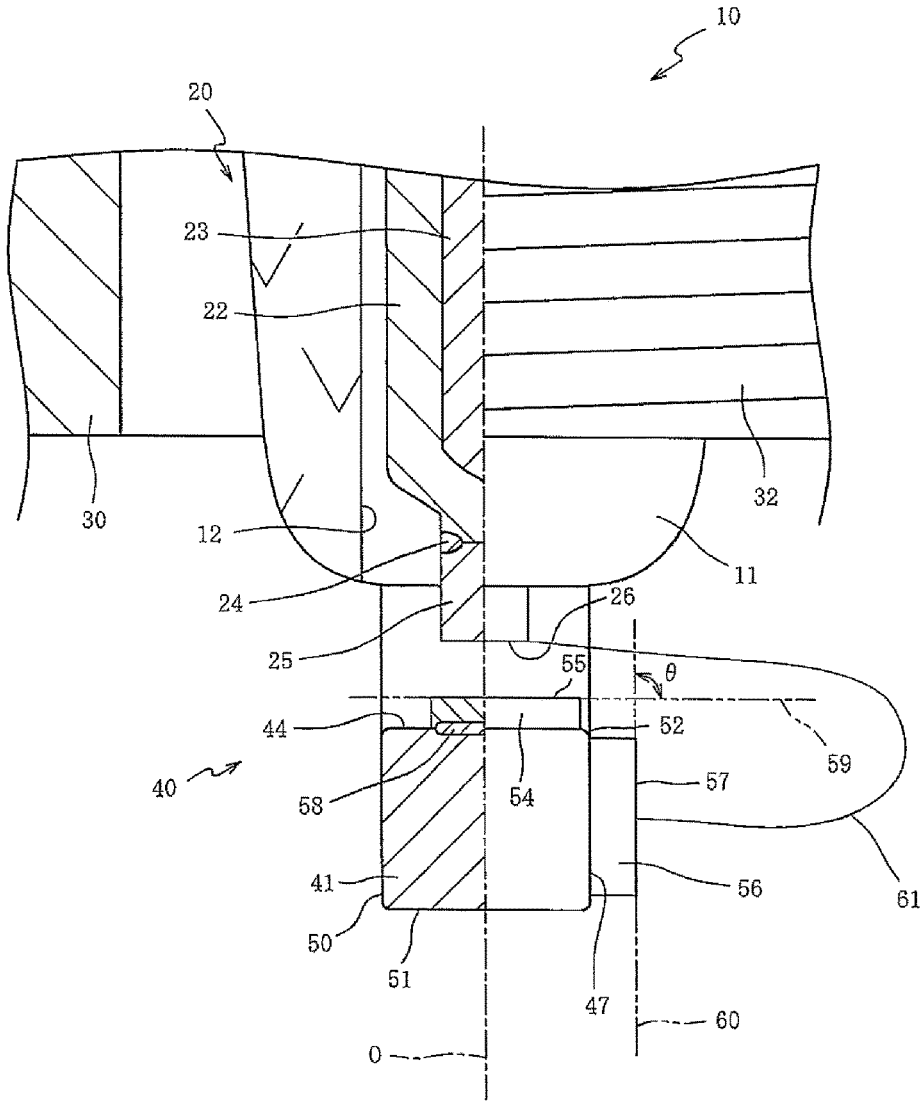
FIG. 3 is an enlarged side view, half in section, of a front end part of the spark plug as viewed in the direction of an arrow III of FIG. 1.

FIG. 3 is an enlarged side view, half in cross section, of the front end part of the spark plug 10 as viewed in the direction of an arrow III of FIG. 1.

In the center electrode 20, the tip 25 is joined to the front end of the electrode base 22 through a weld zone 24 as shown in FIG. 3. In the first embodiment, the weld zone 24 is formed by laser welding and located inside the axial hole 12 of the insulator 11. On the other hand, a front end surface 26-side part of the tip 25 is exposed and protrudes toward the front from the axial hole 12.

In the ground electrode 40, the first tip member 54 is joined to the first surface 44 of the electrode base 41 through a weld zone 58 such that the first discharge surface 55 faces the front end surface 26 of the center electrode 20. In the first embodiment, the weld zone 58 is formed as a nugget by resistance welding. Similarly, the second tip member 56 is joined to the second surface 47 of the electrode base 41 through a weld zone (not shown).

In the tip 53, the second tip member 56 (except the weld zone) is made larger in volume than the first tip member 54 (except the weld zone 58). More specifically, the volume of the second tip member 56 is made 1.3 times or more larger than the volume of the first tip member 54 in the first embodiment.

Further, a first imaginary plane 59 including the first discharge surface 55 of the first tip member 54 and a second imaginary place 60 including the second discharge surface 57 of the second tip member 56 intersect each other at a predetermined angle θ. In the first embodiment, the angle θ formed between the first and secondary imaginary planes 59 and 60 is set to substantially 90°.

The above-structured spark plug 10 can be manufactured by e.g. the following method. The center electrode 20 is first inserted and arranged in the axial hole 12 of the insulator 11 such that the weld zone 24 is located inside the axial hole 12 and such that the front end surface 26 of the center electrode 20 is exposed outside from the axial hole 12. The metal terminal 27 is next inserted in the axial hole 12 and electrically connected to the center electrode 20. Then, the metal shell 30 to which the electrode base 41 has been joined is fitted on the outer circumference of the insulator 11. After the first and second tip members 54 and 56 are joined to the electrode base 41, the electrode base 41 is bent such that the first tip member 54 faces the center electrode 20. With this, the spark plug 10 is obtained.

In a state that the spark plug 10 is mounted to the engine (not shown), the tip 25 of the center electrode 20 and the ground electrode 40 are exposed inside a combustion chamber of the engine. In this mounted state, the third surface 50 of the ground electrode 40 is directed toward the upstream side of the flow of air-fuel mixture in the combustion chamber; and the second surface 47 of the ground electrode 40 is directed toward the downstream side of the flow of air-fuel mixture in the combustion chamber (that is, toward the exhaust valve side).

When insulation between the center electrode 20 and the ground electrode 40 is broken by increase of the secondary voltage of an ignition coil in an ignition device of the engine, so-called capacitive spark is generated between the center electrode 20 and the ground electrode 40 by electric energy accumulated in the secondary circuit. Subsequently, so-called inductive spark is generated by electromagnetic energy of the ignition coil. The inductive spark is lower in current and shorter in duration time than the capacitive spark. This spark discharge is likely to be generated between the center electrode 20 and a part of the ground electrode 40 close to or protruding toward the center electrode 20. In other words, the path of the spark discharge is likely to be formed between the front end surface 26 of the center electrode 20 and the first discharge surface 55 of the first tip member 54.

In the case where the flow rate of air-fuel mixture in the combustion chamber is low, the discharge path is formed between the front end surface 26 of the center electrode 20 and the first discharge surface 55 of the first tip member 54. In the case where the flow rate of air-fuel mixture in the combustion chamber is high as in the lean-burn engine etc., the discharge path is extended by the air-fuel mixture flow toward the downstream side so as to extend from the front end surface 26 of the center electrode 20 to the second surface 47 of the electrode base 41 or the second tip member 56.

In the first embodiment, the second tip member 56 is joined to the second surface 47 of the electrode base 41 as mentioned above so that the discharge path (mainly, the discharge path of the inductive spark), when extended by the air-fuel mixture flow toward the downstream side, is formed between the between the front end surface 26 of the center electrode 20 and the second discharge surface 57 of the second tip member 56 as designated by reference numeral 61 in FIG. 3. Accordingly, spark wear of the electrode base 41 (second surface 47) is suppressed in the first embodiment as compared to the case where no second tip member 56 is joined to the second surface 47. Moreover, the extended discharge path 61 leads to a larger number of fuel particles activated by the spark discharge and a larger flame kernel developed in the combustion chamber. The extended discharge path 61 also leads to a larger distance from the center and ground electrodes 20 and 40 to the flame kernel so that the flame quenching actions of the center and ground electrodes 20 and 40 can be reduced with increasing distance to the frame kernel. It is therefore possible to improve the ignition performance of the spark plug 10.

In the spark plug 10, the higher the temperature of the tip 53, the more susceptible the tip 53 is to spark wear. The first tip member 54 and the second tip member 56 are separated apart from each other in the first embodiment so that, even though the first and second tip members 54 and 56 are heated by the spark discharge, the heat can be prevented from directly transferring from the first tip member 54 to the second tip member 56 or from the second tip member 56 to the first tip member 54 through contact of these tip members 54 and 56. A temperature rise of the tip 53 is suppressed by preventing direct heat transfer between the first and second tip members 54 and 56 and thereby enhancing heat transfer from the first and second tip members 54 and 56 to the electrode base 41. Correspondingly, spark wear of the tip 53 is suppressed. The ground electrode 40 is thus improved in spark wear resistance.

Since the weld zone 58 is formed by meting and fusion welding of the tip 53 (first and second tip members 54 and 56) of noble metal-based material and the electrode base 41 of Ni-based material, the thermal conductivity of the weld zone 58 is lower than that of the tip 53. In the presence of such a weld zone 58, separation of the tip members 54 and 56 is effective in suppressing a temperature rise of the tip member 54, 56 caused by heat transfer. For this reason, it is preferable that the first and second tip members 54 and 56 are separated apart from each other by a distance in the case where the weld zone 58 is formed between the tip 53 and the electrode base 41.

The first tip member 54 is arranged to cover a part of the second side 46 of the first surface 44 of the electrode base 41 to which the second surface 47 with the second tip member 56 is connected. In this arrangement, the occurrence of spark wear in the vicinity of the second side 46 of the first surface 44 is suppressed over a wider area by the first tip member 54. The first surface 44 of the electrode base 41 is thus improved in spark wear resistance. Similarly, the second tip member 56 is arranged to cover a part of the first side 48 of the second surface 47 of the electrode base 41 to which the first surface 44 with the first tip member 54 is connected. In this arrangement, the occurrence of spark wear in the vicinity of the first side 48 of the second surface 47 is suppressed over a wider area by the second tip member 56. The second surface 47 of the electrode base 41 is thus improved in spark wear resistance.

Furthermore, the volume of the second tip member 56 (except the weld zone) is made larger than that of the first tip member 54 (except the weld zone 58) so that the second tip member 56 can ensure lifetime against spark wear due to the discharge path 61 (mainly, the discharge path of the inductive spark) extended by the air-fuel mixture flow.

The weld zone 24 of the center electrode 20, which is more susceptible to spark wear than the tip 25, is located inside the axial hole 12 of the insulator 10 so that spark wear of the weld zone 24 can be suppressed.

Figure 4:
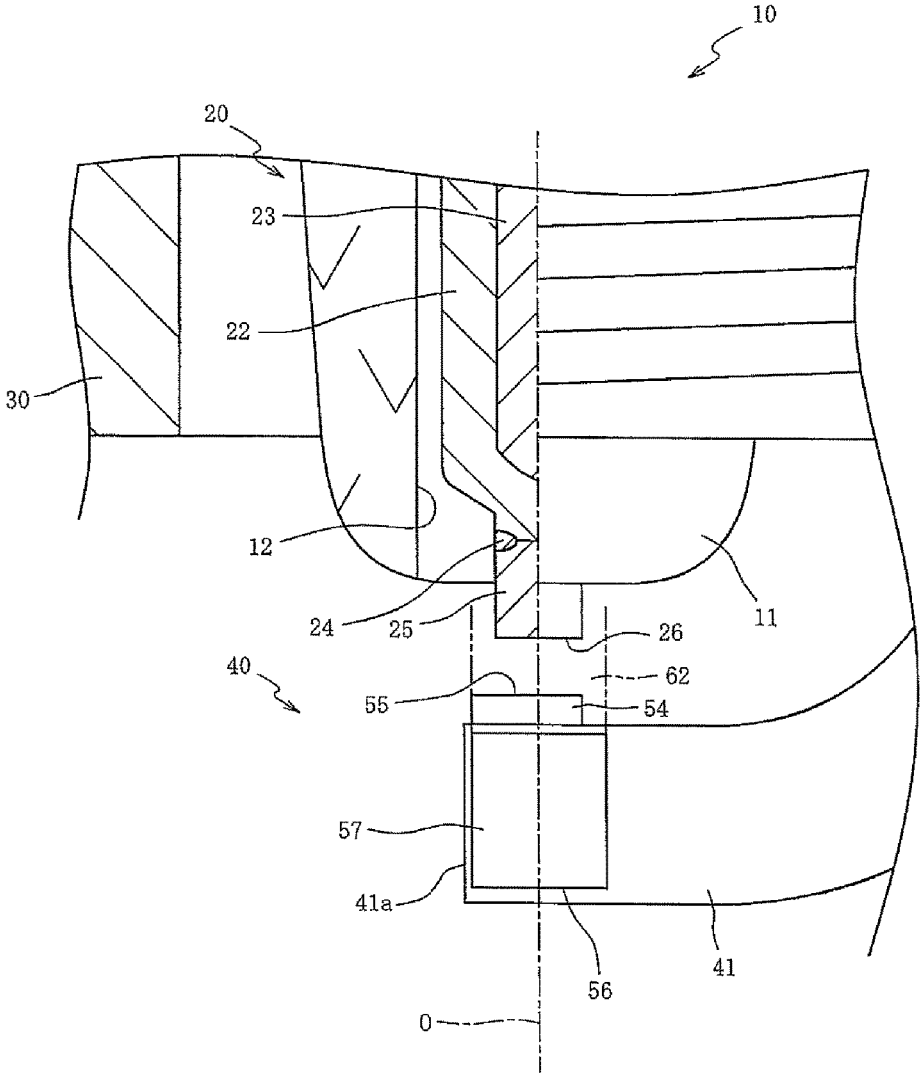
FIG. 4 is an enlarged side view, half in section, of the front end part of the spark plug as viewed in a direction perpendicular to the paper surface of FIG. 1.

FIG. 4 is an enlarged side view, half in section, of the front end part of the spark plug 10 as viewed in a direction perpendicular to the paper surface of FIG. 1.

The ground electrode 40 is so configured that, when the ground electrode 40 is viewed in a direction perpendicular to the second discharge surface 57 of the second tip member 56 as in FIG. 4 (that is, viewed from a direction perpendicular to the paper surface of FIG. 4), the entire front surface 26 of the center electrode 20 is situated within a range 62 of existence of the second tip member 56 in a direction perpendicular to a minimum line segment that connects the front end surface 26 of the center electrode 20 to the first discharge surface 55 of the first tip member 54 in the shortest distance (that is, in a direction parallel to the paper surface of FIG. 4). In this configuration, spark discharge is more likely to be generated between the front end surface 26 of the center electrode 20 and the second tip member 56. Hence, spark wear of the second surface 47 is effectively suppressed (see also FIG. 3).

Further, the ground electrode 40 is so configured that, when the ground electrode 40 is viewed from the direction perpendicular to the second discharge surface 57 as in FIG. 4 (that is, viewed from the direction perpendicular to the paper surface of FIG. 4), the entire first discharge surface 55 of the first tip member 54 is situated within the range 62 of existence of the second tip member 56 in the direction perpendicular to the minimum line segment that connects the front end surface 26 of the center electrode 20 to the first discharge surface 55 of the first tip member 54 in the shortest distance (that is, in the direction parallel to the paper surface of FIG. 4). In this configuration, a ground electrode 40 side-end of the discharge path is readily shifted from the first tip member 54 to the second tip member 56 as designated by reference numeral 61 (see also FIG. 3) when the spark discharge between the center electrode 20 and the first tip member 54 is blown off by the air-fuel mixture flow. Spark wear of the electrode base 41 is hence effectively suppressed.

It is noted that a width of the range 62 of existence of the second electrode tip 56 (i.e. a dimension of the range 62 in the lateral direction of FIG. 4) is equal to a width of the widest portion of the second electrode tip 56.

Second Embodiment

Figure 5:
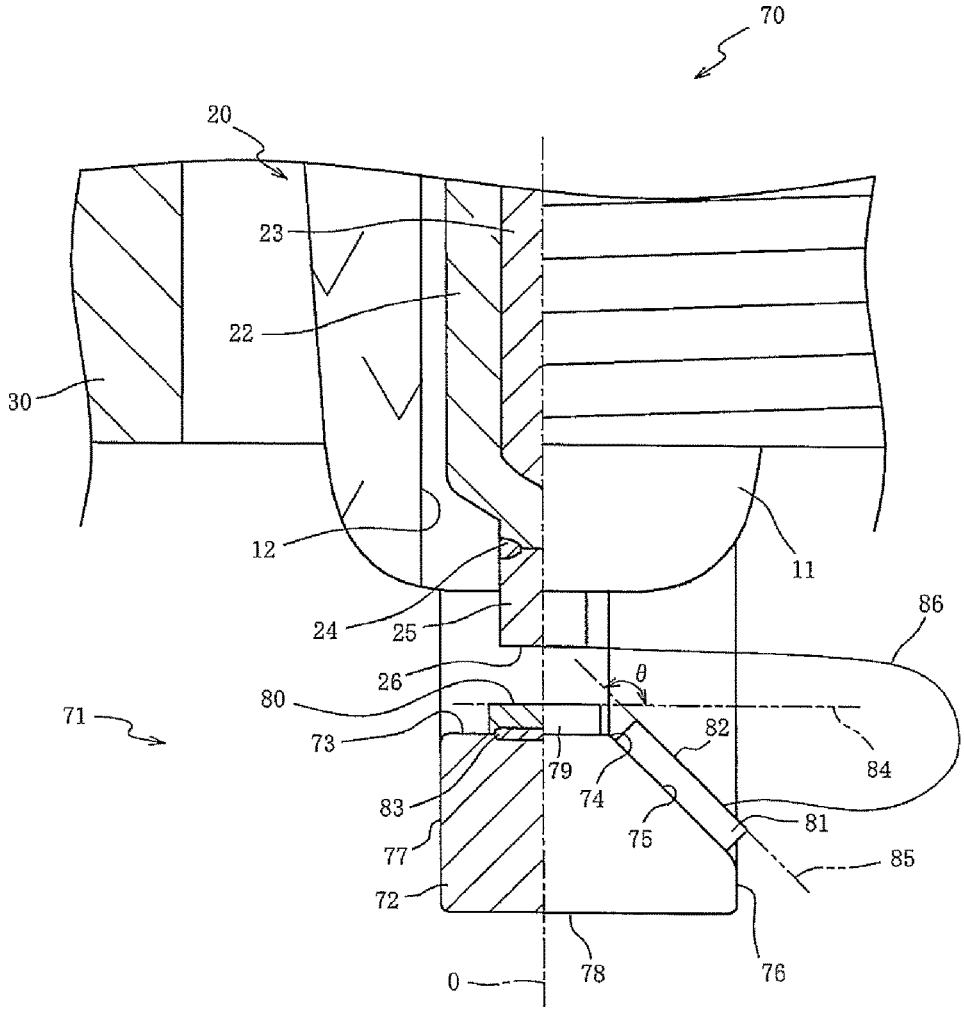
FIG. 5 is an enlarged side view, half in section, of a front end part of a spark plug according to a second embodiment of the present invention.

FIG. 5 is a side view, half in section, of a front end part of a spark plug 70 according to the second embodiment of the present invention. The spark plug 70 according to the second embodiment is structurally the same as the spark plug 10 according to the first embodiment, except for the configuration of a ground electrode 71. Herein, the same parts and portions of the second embodiment as those of the first embodiment are designated by the same reference numerals to omit explanations thereof.

As shown in FIG. 5, the ground electrode 71 of the spark plug 70 includes: an electrode base 72 (as a ground electrode base) made of a Ni-based material; and first and second tip members 79 and 80 (as a ground electrode tip) each made of a noble metal-based material and joined to the electrode base 72.

The electrode base 72 is pentagonal in cross section, having: a first surface 73 facing the front end surface 26 of the center electrode 20; a second surface 75 connected to one side of the first surface 73 via a chamfered region 74; a third surface 77 connected to the other opposite side of the first surface 73; a fourth surface 76 opposed to the third surface 77 and connected to the second surface 75; and a fifth surface 78 connecting the third surface 77 and the fourth surface 76 to each other. In the second embodiment, the first surface 73 and the second surface 75 are oriented to form an obtuse angle. The chamfered region 74 is formed as a beveled surface by cutting off (chamfering) an edge between the first surface 73 and the second surface 75

The first tip member 79 is rectangular plate-shaped and joined to the first surface 73 of the electrode base 72 though a weld zone 83. The weld zone 83 is formed by melting and fusion of the first tip member 79 and the electrode base 72. The first tip member 79 has a first discharge surface 80 facing the front end surface 26 of the center electrode 20 and oriented in the same direction as the first surface 73 (i.e. in a direction perpendicular to the axis O).

The second tip member 80 is rectangular plate-shaped and joined to the second surface 75 of the electrode base 72 through a weld zone (not shown). The weld zone is also formed by melting and fusion of the second tip member 80 and the electrode base 72. The second tip member 80 has a second discharge surface 82 oriented in the same direction as the second surface 75 (i.e. in a direction inclined to the axis O).

In contrast to the first embodiment in which the first imaginary plane 59 and the second imaginary place 60 intersect at substantially 90°, a first imaginary plane 84 including the first discharge surface 80 and a second imaginary plane 85 including the second discharge surface 82 intersect each other at a predetermined obtuse angle θ (>90°) in the second embodiment. The obtuse angle θ formed between the first and second imaginary planes 84 and 85 is preferably in the range of 120° to 170°.

In general, spark discharge is more likely to be generated between the center electrode 20 and a protruding part or center electrode 20 side-part of the second discharge surface 82 than between the center electrode 20 and the other part of the second discharge surface 82. In the case where the first and second imaginary planes 84 and 85 form an obtuse angle θ, the second discharge surface 82 is more oriented and directed toward the center electrode 20 side (i.e. the rear side; the upper side of FIG. 5) as compared to the case where the first and second imaginary planes 84 and 85 intersect at a right angle. It is thus more likely that spark discharge will be generated along a discharge path 86 between the center electrode 20 and the second discharge surface 82. The discharge path 86 is more readily extended toward the center of the combustion chamber by the flow of air-fuel mixture in the combustion chamber (not shown) so as to activate fuel particles in the vicinity of the center of the combustion chamber and thereby achieve improvement in ignition performance.

Third Embodiment

Figure 6:
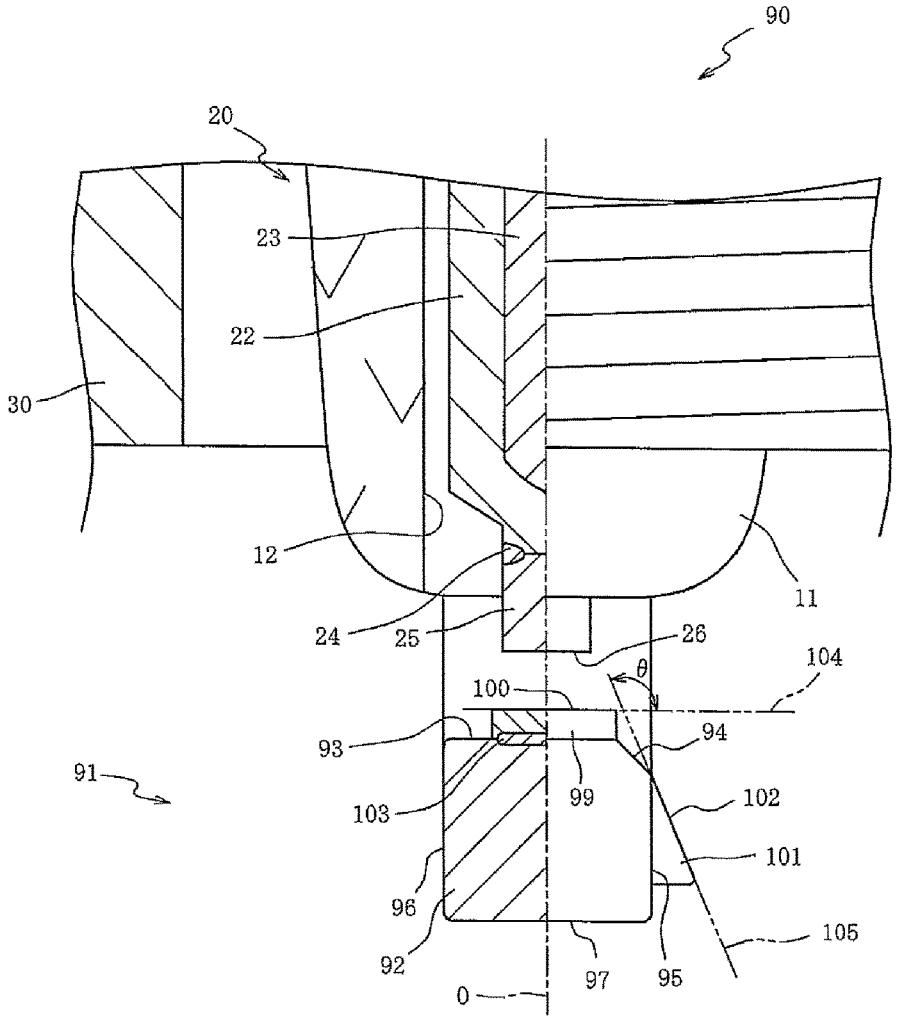
FIG. 6 is an enlarged side view, half in section, of a front end part of a spark plug according to a third embodiment of the present invention.

FIG. 6 is a side view, half in section, of a front end part of a spark plug 90 according to the third embodiment of the present invention. The spark plug 90 according to the third embodiment is structurally the same as the spark plug 10 according to the first embodiment, except for the configuration of a ground electrode 91. Herein, the same parts and portions of the second embodiment as those of the first embodiment are designated by the same reference numerals to omit explanations thereof.

As shown in FIG. 6, the ground electrode 91 of the spark plug 90 includes: an electrode base 92 (as a ground electrode base) made of a Ni-based material; and first and second tip members 99 and 101 (as a ground electrode tip) each made of a noble metal-based material and joined to the electrode base 92.

The electrode base 92 is roughly rectangular in shape, having: a first surface 93 facing the front end surface 26 of the center electrode 20; a second surface 95 connected to one side of the first surface 93 via an intermediate surface 94; a third surface 96 connected to the other opposite side of the first surface 93; and a fourth surface 97 connecting the second surface 95 and the third surface 96 to each other. The second surface 95 is oriented substantially perpendicular to the first surface 93. The intermediate surface 94 is formed as a flat surface connecting the first surface 93 and the second surface 95 to each other.

The first tip member 99 is rectangular plate-shaped and joined to the first surface 93 of the electrode base 92 though a weld zone 103. The weld zone 103 is formed by melting and fusion of the first tip member 99 and the electrode base 92. The first tip member 99 has a first discharge surface 100 facing the front end surface 26 of the center electrode 20 and oriented in the same direction as the first surface 93 (i.e. in a direction perpendicular to the axis O).

The second tip member 101 is substantially triangular prism-like shaped and joined to the second surface 95 of the electrode base 92 though a weld zone (not shown). The weld zone is formed by melting and fusion of the second tip member 101 and the electrode base 92. The second tip member 101 has a second discharge surface 102 oriented in a direction inclined to the second surface (i.e. inclined to the axis O).

In contrast to the second embodiment in which the rectangular plate-shaped first and second tip members 79 and 81 are joined to the obtusely oriented first and second surfaces 73 and 75 of the electrode base 72 whereby the first imaginary plane 84 and the second imaginary plane 85 intersect at an obtuse angle θ, the rectangular plate-shaped first tip member 99 and the triangular prism-like shaped second tip member 101 are joined to the perpendicularly oriented first and second surfaces 93 and 95 of the electrode base 92 whereby a first imaginary plane 104 including the first discharge surface 100 and a secondary imaginary plane 105 including the second discharge surface 102 intersect at a predetermined obtuse angle θ (>90°) in the third embodiment. The obtuse angle θ formed between the first and second imaginary planes 104 and 105 is preferably in the range of 120° to 170°.

Since the first imaginary surface 104 and the second imaginary surface 105 form an obtuse angle θ in the third embodiment as in the second embodiment, it is possible in the third embodiment to obtain the same effects as in the second embodiment.

Fourth Embodiment

Figure 7:
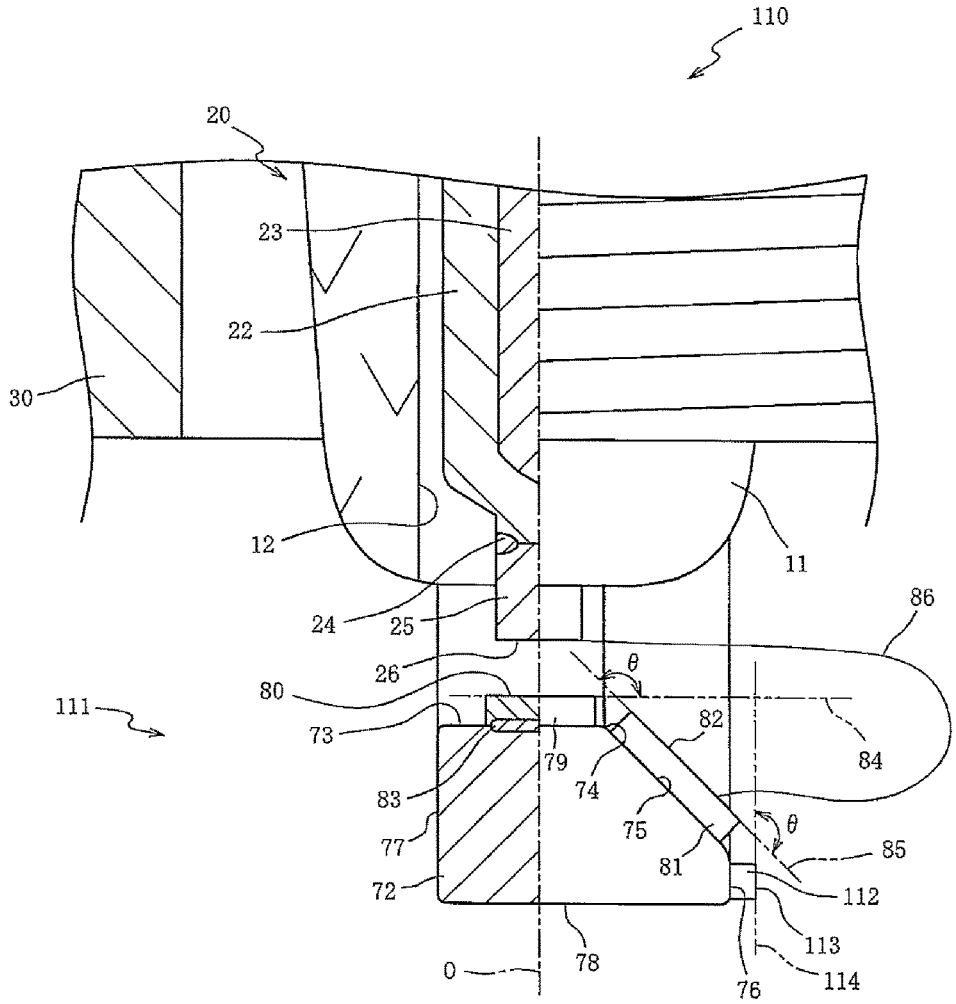
FIG. 7 is an enlarged side view, half in section, of a front end part of a spark plug according to a fourth embodiment of the present invention.

FIG. 7 is a side view, half in section, of a front end part of a spark plug 110 according to the fourth embodiment of the present invention. The spark plug 110 according to the fourth embodiment is structurally the same as the spark plug 10, 70 according to the first or second embodiment, except for the configuration of a ground electrode 111. Herein, the same parts and portions of the second embodiment as those of the first or second embodiment are designated by the same reference numerals to omit explanations thereof.

As shown in FIG. 7, the ground electrode 111 of the spark plug 110 includes: a third tip member 112 made of a noble metal-based material and joined to the fourth surface 76 of the electrode base 72 in addition to the first and second tip members 79 and 81 respectively joined to the first and second surfaces 73 and 75 of the electrode base 72. The third tip member 112 is rectangular plate-shaped and joined to the fourth surface 79 of the electrode base 72 through a weld zone (not shown). The weld zone is formed by melting and fusion of the third tip member 112 and the electrode base 72. The third tip member 112 is separated apart from each of the first and second tip members 79 and 81, and has a flat third discharge surface 113 oriented such that a third imaginary plane 114 including the third discharge surface 113 intersects the second imaginary plane 85 at a predetermined obtuse angle θ (>90°). The obtuse angle θ formed between the second and third imaginary planes 85 and 114 is preferably in the range of 120° to 170°.

In the fourth embodiment, spark wear of the fourth surface 76 is effectively suppressed as the third tip member 112 is joined to the fourth surface 76 of the electrode base 72. When spark discharge is generated along a discharge path 86 between the center electrode 20 and the third tip member 112, the discharge path 86 is readily extended toward the center of the combustion chamber so as to activate fuel particles in the vicinity of the center of the combustion chamber and thereby achieve improvement in ignition performance.

EXAMPLES

The present invention will be described in more detail below by way of the following experimental examples. It is noted that the following experimental examples are merely intended to enhance understanding of the present invention and are not intended to limit the present invention thereto.

(Experimental Test 1)

A spark plug was produced as a test sample in which each of center and ground electrodes had a tip joined to an electrode base thereof. The electrode bases of the center and ground electrodes used were each made of a Ni-based alloy. The tip of the center electrode used (hereinafter referred to as "center electrode tip") was made of Ir. The tip of the ground electrode used (hereinafter referred to as "ground electrode tip") was made of a Pt-based alloy containing 10 wt % of Ni and circular disk-shaped with a diameter of 1.6 mm and a thickness of 0.5 mm.

The thus-produced spark plug was mounted to a test engine and connected to an ignition coil in an ignition device of the test engine. While air-fuel mixture was supplied to a combustion chamber of the test engine, the pressure inside the combustion chamber was controlled to 1.5 MPa. In such a state, test was conducted on the spark plug by charging the ignition coil with electromagnetic energy of 50 mJ and causing spark discharge between the center and ground electrodes of the spark plug at a charge/discharge frequency of 60 Hz for 250 hours. This charge/discharge frequency (60 Hz) corresponds to 720 rpm of a four-stroke engine. Further, 100 hours of the test corresponds to about 50,000 km driving of a vehicle by an ordinary driver.

The spark plug was dismounted from the test engine every 50 hours until the lapse of 250 hours from the initiation of the test. Every time the spark plug was dismounted, the clearance between the center electrode tip and the ground electrode tip was measured with a gage. The amount of wear (thickness decrease) of the ground electrode tip was determined by subtracting the amount of wear (thickness decrease) of the center electrode tip from the measured clearance. The test results are shown in TABLE 1.

TABLE 1

| Time (hr) | Wear Amount (mm) |
|---|---|
| 50 | 0.03 |
| 100 | 0.10 |
| 150 | 0.13 |

TABLE 1-continued

| Time (hr) | Wear Amount (mm) |
|---|---|
| 200 | 0.17 |
| 250 | 0.20 |

As shown in TABLE 1, the amount of wear (thickness decrease) of the ground electrode tip after the lapse of 100 hours from the initiation of the test was 0.1 mm. It is thus apparent that the ground electrode tip, when formed with a thickness of 0.1 mm or larger, ensures sufficient lifetime against spark wear.

The amount of wear of the ground electrode tip increases with the test time. Thus, the larger the thickness of the ground electrode tip, the longer the lifetime of the ground electrode tip. On the other hand, the mass of the ground electrode tip increases proportionally with the thickness of the ground electrode tip. The load applied to the electrode base on which the ground electrode tip is supported increases as the ground electrode tip becomes larger in thickness. The application of high load can result in deformation or breakage of the ground electrode base under a high-temperature environment. In view of these facts, the upper limit of the thickness of the ground electrode tip would preferably be set to 1.0 mm.

(Experimental Test 2)

Figure 8A:
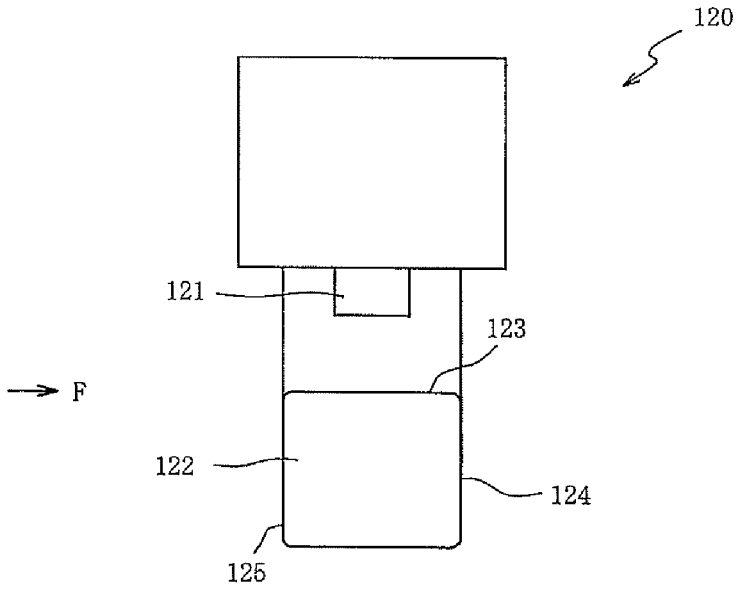
FIGS. 8A and 8B are schematic views showing experimental tests.

FIG. 8A is a schematic view showing a spark plug 120 produced and used as a test sample in this experimental test. As shown in FIG. 8A, the spark plug 120 was provided with a center electrode 121 and a ground electrode 122 such that a first surface 123 of the ground electrode 122 faced the center electrode 121 via a spark gap. The ground electrode 122 used consisted of a rectangular cross-section electrode base of Ni-based alloy with no tip joined thereto.

The spark plug 120 was mounted to a flow channel, which was uniform in cross-sectional area from its upstream end to downstream end, with a third surface 125 of the ground electrode 122 being directed to the upstream side of the flow F of test gas and with a second surface 124 of the ground electrode 122 being directed to the downstream side of the flow F of the test gas. The position of the spark plug 120 was adjusted such that the spark gap of the spark plug 120 was located in the center of the cross-sectional area of the flow channel. While the test gas was fed at a flow rate of 10 m/s through the flow channel, electric spark was generated by causing discharge between the center electrode 121 and the ground electrode 122. The test gas used was air. The discharge energy for each electric spark was 100 mJ.

In the test, 100 times of the discharge was photographed with a high-speed camera to measure the time (A) of the discharge between the center electrode 121 and the first surface 123 of the ground electrode 122 and the time (B) of the discharge between the center electrode 121 and the second surface 124 of the ground electrode 120. The ratio of the discharge time B to the total discharge time A+B was determined to be 57%.

In view of the above result that the time B of discharge at the second surface is longer than the time A of discharge at the first surface, it is apparent that the second tip member ensures lifetime against spark wear due to the discharge path extended by the flow of air-fuel mixture when the second tip member joined to the second surface has a larger volume than that of the first tip member joined to the first surface. In particular, it is apparent in view of the ratio of the discharge time B to the discharge time A (B/A=57%/43%) that the second tip member ensures its spark wear resistance when the volume of the second tip member is 1.3 times or more larger than that of the first tip member.

(Experimental Test 3)

Figure 8B:
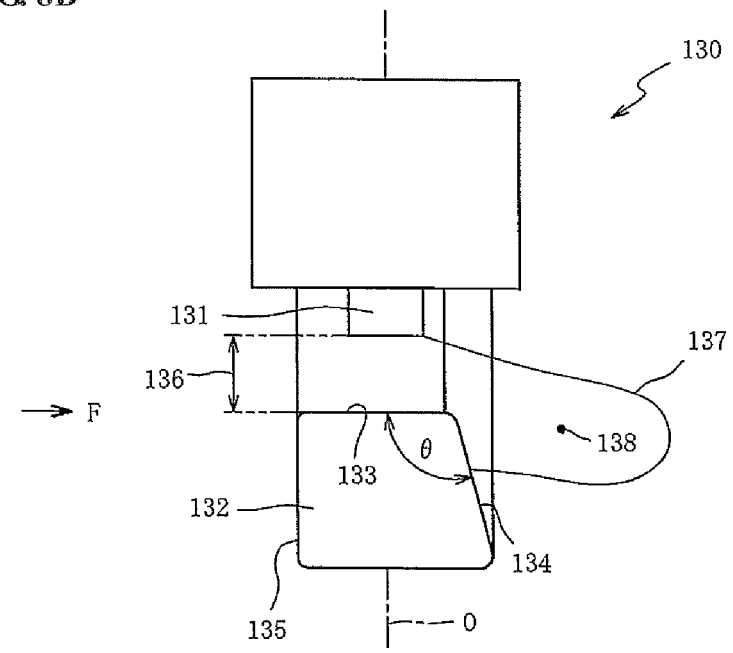

FIG. 8B is a schematic view showing a spark plug 130 produced and used as a test sample in this experimental test. As shown in FIG. 8B, the spark plug 130 was provided with a center electrode 131 and a ground electrode 132 such that a front end surface of the center electrode 131 and a first surface 133 of the ground electrode 132 faced in parallel with each other via a spark gap 136. The ground electrode 132 used consisted of an electrode base of Ni-based alloy with no tip joined thereto.

The spark plug 130 was mounted to a flow channel, which was uniform in cross-sectional area from its upstream end to downstream end, with a third surface 135 of the ground electrode 132 being directed to the upstream side of the flow F of test gas and with a second surface 134 of the ground electrode 122 being directed to the downstream side of the flow F of the test gas. The position of the spark plug 130 was adjusted such that the spark gap 136 of the spark plug 130 was located in the center of the cross-sectional area of the flow channel. While the test gas was fed at a flow rate of 10 m/s through the flow channel, electric spark was generated by causing discharge along a discharge path 137 between the center electrode 131 and the second surface 134 of the ground electrode 132. The test gas used was air. The discharge energy for each electric spark was 100 mJ.

In the test, 100 times of the discharge was photographed with a high-speed camera. The thus-obtained image data was each subjected to image processing. Assuming a plane figure surrounded by the discharge path 137 and a line segment connecting both ends of the discharge path 137, the center of gravity of the plane figure was determined as the center 138 of gravity of the discharge path 137. Herein, the center 138 of gravity was determined by a known method using an arithmetic mean of coordinates of the plane figure, a moment of the plane figure etc. Based on the determination results, the average position of the center 138 of gravity was determined.

The positional relationship of the angle θ with the center 138 of gravity was tested by using a plurality of test samples in which the angle θ between the first and second surfaces 133 and 134 was changed without changing the sizes of the first and second surfaces 133 and 134. The test sample was rated as "A" when the average position of the center 138 of gravity was located frontward of the first surface 133 (i.e. on the lower side of FIG. 8B with respect to the first surface 133). On the other hand, the test sample was rated as "B" when the average position of the center 138 of gravity was located rearward of the first surface 133 (i.e. on the upper side of the FIG. 8B with respect to the first surface 133). The test results are shown in TABLE 2.

TABLE 2

| Angle θ (°) | Rating |
|---|---|
| 90 | B |
| 100 | B |
| 110 | B |
| 120 | A |
| 130 | A |
| 140 | A |
| 150 | A |
| 160 | A |
| 170 | A |
| 180 | B |

As shown in TABLE 2, the rating was "A" in the range of 120°≤θ≤170°. It is considered that the center 138 of gravity of the discharge path 137 would be brought closer to the center of the engine combustion chamber in the "A"-rated spark plug than in the "B"-rated spark plug. The closer the center of gravity of the discharge path is to the center of the combustion chamber, the more readily the fuel particles in the vicinity of the center of the combustion chamber are activated by spark discharge. Accordingly, the "A"-rated spark plug would have better ignition performance than the "B"-rated spark plug. It is thus apparent that the spark plug is more improved in ignition performance in the range of 120°≤θ≤170°.

Although the present invention has been described with reference to the above embodiments, the above embodiments are intended to facilitate understanding of the present invention and are not intended to limit the present invention thereto. Various changes and modifications can be made to the above embodiments without departing from the scope of the present invention.

In the above embodiments, the electrode base 41, 71, 92 of the ground electrode 40, 71, 91, 111 is rectangular or pentagonal in cross section. However, the cross-sectional shape of the electrode base of the ground electrode is not necessarily limited to such a rectangular or pentagonal shape and can be set as appropriate. For example, the electrode base of the ground electrode may alternatively be semicircular in cross section.

In the above embodiments, the first tip member 54, 79, 99, the second tip member 56, 81 and the third tip member 112 of the ground electrode 40, 71, 91, 111 are rectangular plate (parallelepiped)-shaped. The cross-sectional shape of the first, second, third tip member of the ground electrode is however not necessarily limited to such a rectangular plate shape and can be set as appropriate. For example, each of the first, second and third tip members of the ground electrode may be formed into any disk shape other than the rectangular plate shape as in the case of the above Experimental Test 1.

In the above first embodiment, the first tip member 54 is arranged to cover the part of the second side 46 of the first surface 44 adjacent to the distal end surface 41*a* of the electrode base 41; and the second tip member 56 is arranged to cover the part of the first side 48 of the second surface 47 adjacent to the distal end surface 41*a* of the electrode base 41. However, the arrangement positions of the first and second tip members 54 and 56 are not necessarily limited to such positions. As the size of the tip 53 and the length of the distal end portion 42 of the electrode base 41 can be set as appropriate, it is feasible to arbitrarily adjust the distance between the tip 53 and the distal end surface 41*a* of the electrode base 41. The same applies to the above second to fourth embodiments.

In the above embodiments, the second tip member 56, 81, 101 is joined to the second surface 47, 75, 95 of the electrode base 41, 71, 92 with no second tip member being joined to the third surface 50, 77, 96 of the electrode base 41, 71, 92. The tip of the ground electrode is however not necessarily limited to such configuration. In addition to or in place of the second tip member 56, 81, 101 joined to the second surface 47, 75, 95, a second electrode tip may be joined to the third surface 50, 77, 96. By joining the second electrode tip to the third surface 50, 77, 96, spark wear of the third surface 50, 77, 96 is effectively suppressed.

Furthermore, a third tip member may be joined to the distal end surface 41*a* of the electrode base 41. By joining the third tip member to the distal end surface 41*a*, spark wear of the distal end face 41 is effectively suppressed.

Each of the above embodiments may be modified by adding thereto one or more of the features of the other embodiments or by replacing one or more of the features of the embodiment with those of the other embodiments. For example, the spark plug 10 of the first embodiment may be modified by joining the second tip member 101 of the third embodiment, in place of the second tip member 56, to the second surface 47 of the electrode base 41. In this modified embodiment, the second imaginary plane 105 including the second discharge surface 102 of the second tip member 101 forms an obtuse angle with the first imaginary surface 59.

As a matter of course, the chamfered region 52 of the electrode base 41 may alternatively be formed as a beveled surface in the above first embodiment. In the above second or fourth embodiment, the chamfered region 74 of the electrode base 72 may alternatively be formed as a round curved surface. In the above third embodiment, the intermediate surface 94 of the electrode base 92 may alternatively be omitted or be formed as a curved surface.

The entire contents of Japanese Patent Application No. 2018-001558 (filed on Jan. 10, 2018) and No. 2018-153403 (filed on Aug. 17, 2018) are herein incorporated by reference. The scope of the present invention is defined with reference to the following claims.

Having described the invention, the following is claimed:

1. A spark plug, comprising:

an insulator having an axial hole formed therein in a direction of an axis of the spark plug;

a center electrode disposed in a front end side of the axial hole;

a cylindrical metal shell holding therein the insulator; and a ground electrode having a rod-shaped ground electrode base made of a Ni-based material and coupled at a base end portion thereof to the metal shell and a ground electrode tip made of a noble metal-based material and joined to a distal end portion of the ground electrode base, wherein the distal end portion of the ground electrode base has: a first surface facing a front end surface of the center electrode; and second and third surfaces connected to the first surface and extending from the distal end portion toward the base end portion of the ground electrode base, wherein the ground electrode tip includes: a first tip member joined to the first surface and having a first discharge surface so as to allow spark discharge between the center electrode and the first discharge surface; and a second tip member joined to at least one of the second and third surfaces and having a second discharge surface so as to allow spark discharge between the center electrode and the second discharge surface, and wherein the first and second tip members are separated apart from each other.

2. The spark plug according to claim 1, wherein the first tip member covers at least a part of a side of the first surface to which the at least one of the second and third surfaces is connected.

3. The spark plug according to claim 1, wherein the second tip member covers at least a part of a side of the at least one of the second and third surfaces to which the first surface is connected.

4. The spark plug according to claim 1, wherein a height of the first tip member from the first surface in a direction perpendicular to the first surface and a height of the second tip member from the at least one of the second and third surfaces in a direction perpendicular to the at least one of the second and third surfaces are 0.1 to 1 mm.

5. The spark plug according to claim 1, wherein a first imaginary plane including the first discharge surface and a second imaginary plane including the second discharge surface form an obtuse angle.

6. The spark plug according to claim 5, wherein the obtuse angle is 120 to 170°.

7. The spark plug according to claim 1, wherein a volume of the second tip member is larger than a volume of the first tip member.

8. The spark plug according to claim 7, wherein the volume of the second tip member is 1.3 times or more larger than the volume of the first tip member.

9. The spark plug according to claim 1, wherein the center electrode has: a center electrode base; and a center electrode tip made of a noble metal-based material and joined to a front end of the center electrode base through a weld zone, and wherein the weld zone is located inside the axial hole of the insulator.

10. The spark plug according to claim 1, wherein, when the ground electrode is viewed from a direction perpendicular to the second discharge surface, the entire front end surface of the center electrode is situated within a range of existence of the second tip member in a direction perpendicular to a minimum line segment that connects the front end surface of the center electrode to the first discharge surface of the first tip member.

11. The spark plug according to claim 1, wherein, when the ground electrode is viewed from a direction perpendicular to the second discharge surface, the entire first discharge surface of the first tip member is situated within a range of existence of the second tip member in a direction perpendicular to a minimum line segment that connects the front end surface of the center electrode to the first discharge surface of the first tip member.

* * * * *